US006758582B1

(12) United States Patent
Hsiao et al.

(10) Patent No.: US 6,758,582 B1
(45) Date of Patent: Jul. 6, 2004

(54) LED LIGHTING DEVICE

(75) Inventors: Ya-Kuang Hsiao, Chia-I (TW); Ching-Chi Shaw, Taipei (TW)

(73) Assignee: Elumina Technology Incorporation, Taipei (TW)

( * ) Notice: Subject to any disclaimer, the term of this patent is extended or adjusted under 35 U.S.C. 154(b) by 0 days.

(21) Appl. No.: 10/249,145

(22) Filed: Mar. 19, 2003

(51) Int. Cl.[7] ..... F21V 7/00

(52) U.S. Cl. ..... 362/302; 362/303; 362/304; 362/305

(58) Field of Search ..... 362/298, 302, 362/303, 304, 305, 346

(56) References Cited

U.S. PATENT DOCUMENTS 1,050,466 A * 1/1913 Jones, Jr. ..... 362/303
3,796,886 A * 3/1974 Freeman ..... 250/493.1
4,463,410 A * 7/1984 Mori ..... 362/20
4,587,601 A * 5/1986 Collins ..... 362/235
4,755,916 A * 7/1988 Collins ..... 362/236
6,558,032 B2 * 5/2003 Kondo et al. ..... 362/516

* cited by examiner

*Primary Examiner*—Thomas M. Sember
(74) *Attorney, Agent, or Firm*—Winston Hsu

(57) ABSTRACT

9A light emitting diode (LED) lighting device includes a concave mirror and a convex mirror having a diameter less than a diameter of the concave mirror. The convex mirror is positioned to face the concave mirror and is fixed to the concave mirror. An LED array is fixed to the concave mirror between the concave mirror and the convex mirror. The LED array faces the convex mirror such that light emitted by the LED array reflects off of the convex mirror. A power supply is provided for powering the LED array. Light emitted by the LED array is reflected from the convex mirror onto the concave mirror, and then reflected by the concave mirror to exit the lighting device.

11 Claims, 6 Drawing Sheets

LED LIGHTING DEVICE

BACKGROUND OF INVENTION

1. Field of the Invention

The present invention relates to an electrical lighting device, and more specifically, to an electrical lighting device utilizing light emitting diodes (LEDs).

2. Description of the Prior Art

Light emitting diodes (LEDs) are frequently selected for large-scale lighting applications, such as traffic lights and other indicator lights. LEDs provide high intensity light with substantially reduced heat generation when compared with incandescent light bulbs. LEDs also consume significantly less power than other sources of light, have a relatively long life and are easily incorporated into digital circuits.

One disadvantage of LEDs is their small size. Typically, LEDs are not readily scalable to larger sizes or higher brightness. In contrast, if greater intensity of light is required in an incandescent application, an incandescent light bulb can be easily exchanged for one having a higher power rating, and consequent physical characteristics, for delivering increased intensity of light. Power ratings and intensities of conventional light bulbs (incandescent, halogen, etc) range from 40W household bulbs to high power bulbs used in spotlights having millions of candlepower, where single LEDs are usually only suitable for smaller applications. To overcome this deficiency of LEDs, conventional practice has been to array a group of LEDs into a single lighting device to achieve increased brightness.

An example of a conventional lighting device incorporating LEDs is shown in FIG. 1. A lighting device 10 comprises a housing 12, a substrate 16, an LED array 18, an optical lens set 22, and a mask 14. The substrate 16 is disposed inside the housing 12. The LED array 18 includes a plurality of LEDs 24 disposed on the substrate 16 for generating red, green, yellow, blue, white or other colored light. A first reflector set 20 comprises a plurality of reflectors 26 installed on the substrate 16 in an array corresponding to the LED array 18. The optical lens set 22 comprises a plurality of lenses 28 installed above the LED array 18 in a corresponding array for focusing light emitted by the LEDs 24 and reflected by the reflectors 26. The light focused by the optical lens set 22 penetrates the mask 14 installed on the housing 12.

Please refer to FIG. 2 illustrating a schematic diagram of light rays emitted by the lighting device 10. A light ray 30 generated by an LED 24 is focused directly by the corresponding lens 28. Each of lenses 28 concentrates light emitted by a corresponding LED 24 and transmits light within a range of angle 34. Finally, the light, focused by the optical lens set 22, penetrates the mask 14 of the lighting device 10.

Due to the structure of the lighting device 10, most of the light focused by the optical lens set 22 penetrates the central part of the mask 14. The remaining light focused by the optical lens set 22 is transmitted to the circumference of the mask 14. Light intensity at the central part of the mask 14 higher than light intensity near the circumference of the mask. Consequently, light emitted by the lighting device 10 is non-uniform in intensity over the surface of the mask.

SUMMARY OF INVENTION

It is therefore a primary objective of the claimed invention to provide an uncomplicated and inexpensive LED lighting device for providing a more uniform light intensity profile.

Briefly summarized, the claimed invention includes a concave mirror and a convex mirror having a diameter less than a diameter of the concave mirror. The convex mirror is positioned to face the concave mirror and is fixed to the concave mirror. A light emitting diode (LED) array Is fixed to the concave mirror between the concave mirror and the convex mirror. The LED array faces the convex mirror such that light emitted by the LED array reflects off of the convex mirror and onto the concave mirror. A power supply is provided for powering the LED array. Light emitted by the LED array is reflected from the convex mirror onto the concave mirror, and then reflected by the concave mirror to exit the lighting device.

According to an embodiment of the claimed invention, the concave and convex mirrors are parabolic mirrors having metal or plastic bodies coated in metallic reflective material forming reflecting surfaces. The optical axes of the concave and convex mirrors and a central normal axis of the LED array are substantially collinear (or confocal). The LED array is a flat circular array fixed to the metallic reflecting surface of concave mirror. Each LED of the LED array can include a lens for concentrating light onto the convex mirror. Further provided are three stays for attaching the convex mirror to the concave mirror, and a translucent cover spanning the diameter of the concave mirror for protecting the reflecting surfaces of the concave and convex mirrors and the LED array.

It is an advantage of the claimed invention that the concave and convex mirrors can evenly distribute light emitted by the LED array.

It is a further advantage of the claimed invention that light can be delivered to a confined area from an LED array using few components.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
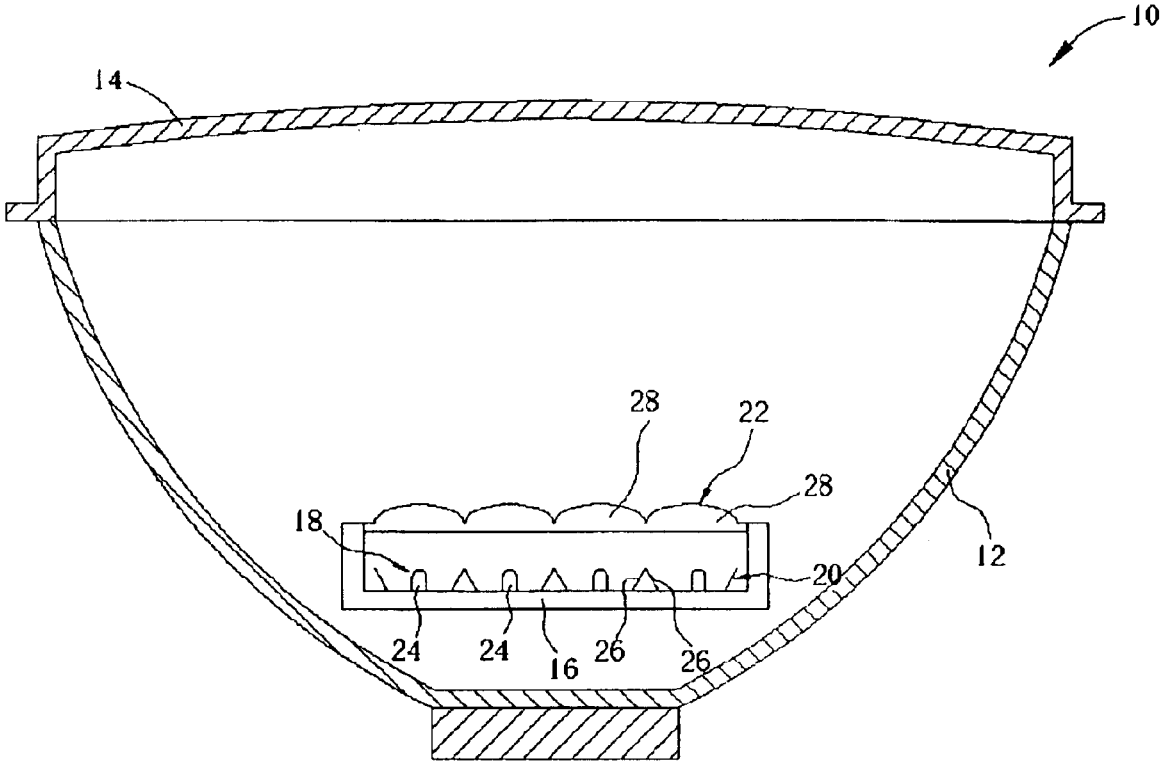
Fig. 1 Prior art
FIG. 1 is a cross-sectional view of a prior art LED lighting device.
Figure 2:
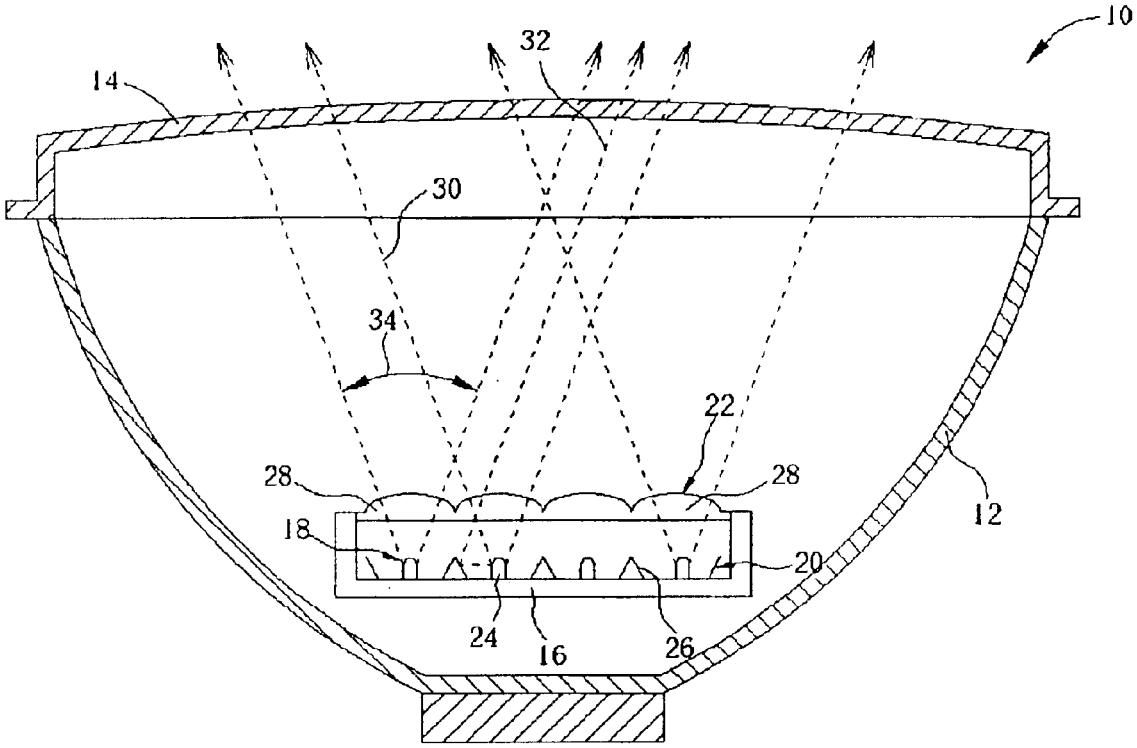
Fig. 2 Prior art
FIG. 2 is a cross-sectional view of the LED lighting device of FIG. 1 illustrating light rays.
Figure 3:
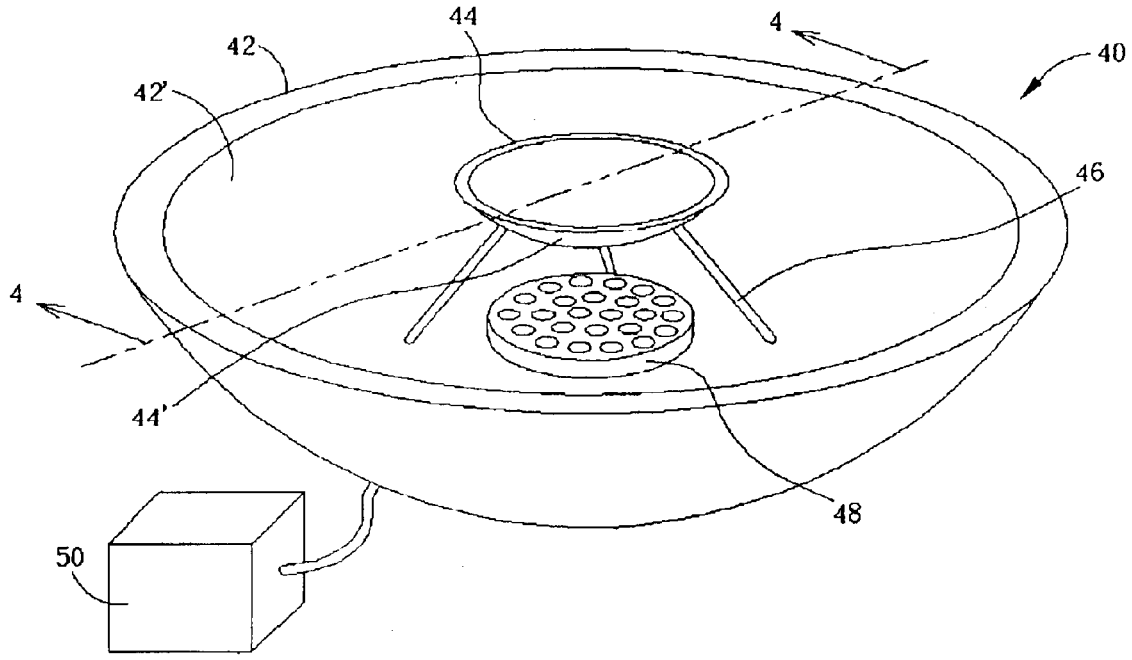
FIG. 3 is a perspective view of an LED lighting device according to a first embodiment of the present invention.

Please refer to FIG. 3 showing a perspective view of an LED lighting device 40 according to a first embodiment of the present invention. The lighting device 40 includes a concave mirror 42 having a reflecting surface 42" and a convex mirror 44 of smaller diameter having a reflecting surface 44". The concave and convex mirrors 42, 44 have plastic bodies providing structural strength which are coated in a metallic reflective material that form the reflecting surfaces 42", 44". Ideally, the concave and convex mirrors 42, 44 are parabolic mirrors, however, spherical mirrors or mirrors of other forms can be used if reduced focusing accuracy can be tolerated. The convex mirror 44 is held in a centrally aligned position by three stays 46 fixed to the concave mirror 42, such that the optical axes of the concave and convex mirrors line up (collinear). In FIG. 3, an LED module 48 having a circular array of Fresnel lenses is provided centrally positioned in the concave mirror 42. The lighting device further comprises a power supply 50 for powering the LED module 48, and a removable translucent cover (ref. 52 FIG. 4) for protecting the reflecting surfaces 42", 44" of the concave and convex mirrors 42, 44 and the LED module 48.

Figure 4:
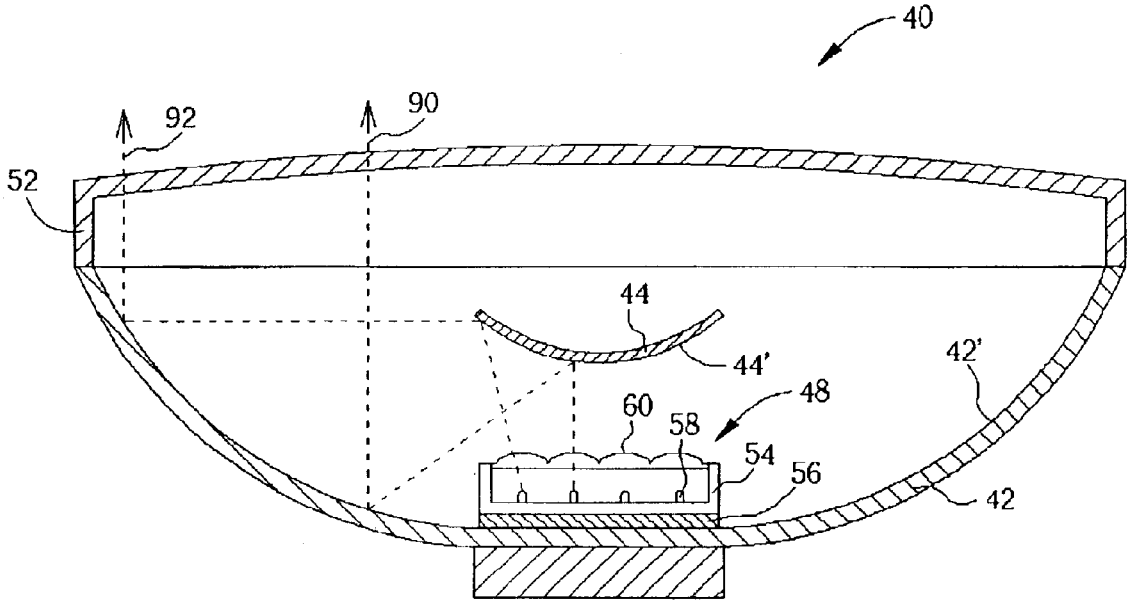
FIG. 4 is a cross-sectional view of the LED lighting device of FIG. 3.

FIG. 4 shows a cross-sectional view of the lighting device 40 according to section line 4—4 of FIG. 3. In FIG. 4 the cover 52 is shown, however, the stays 46 and power supply 50 are omitted for clarity. The LED module 48 includes a base or substrate 54 fixed to the concave mirror 42 and thermally connected to the reflecting surface 42" by a thermally conductive member 56. The LED module 48 further includes an array of LEDs 58 disposed on the base 54 and a corresponding array of lenses 60 connected to the base 54. The lenses 60 are provided to concentrate light emitted by the LEDs 58 onto the convex mirror 44. The thermally conductive member 56 can be a simple mechanical support such as a metal base plate. The thermally conductive member 56 conducts heat generated by the LEDs 58 to the reflecting surface 42" of the concave mirror 42 to be released by thermal convection. Light emitted by the LEDs 58 is focused by the lenses 60, reflected by the convex mirror 44, reflected by the concave mirror 42, before finally exiting the lighting device 40 through the cover 52.

FIG. 4 further illustrates two light rays 90, 92 being emitted by the lighting device 40. The light rays 90, 92 are emitted by different LEDs 58 and are reflected by different regions of the concave and convex mirrors 42, 44 and exit the lighting device 40 substantially parallel to the optical axis of the concave mirror 42. The radii and dimensions of the concave and convex mirrors 42, 44, the position of the convex mirror 44 relative to the concave mirror 42, and the spacing of the LEDs 58 and spacing and focal lengths of the corresponding lenses 60 can be selected to produce a desired lighting effect. FIG. 4 illustrates these parameter selected for emission of substantially parallel light rays exemplified by light rays 90, 92.

Figure 5:
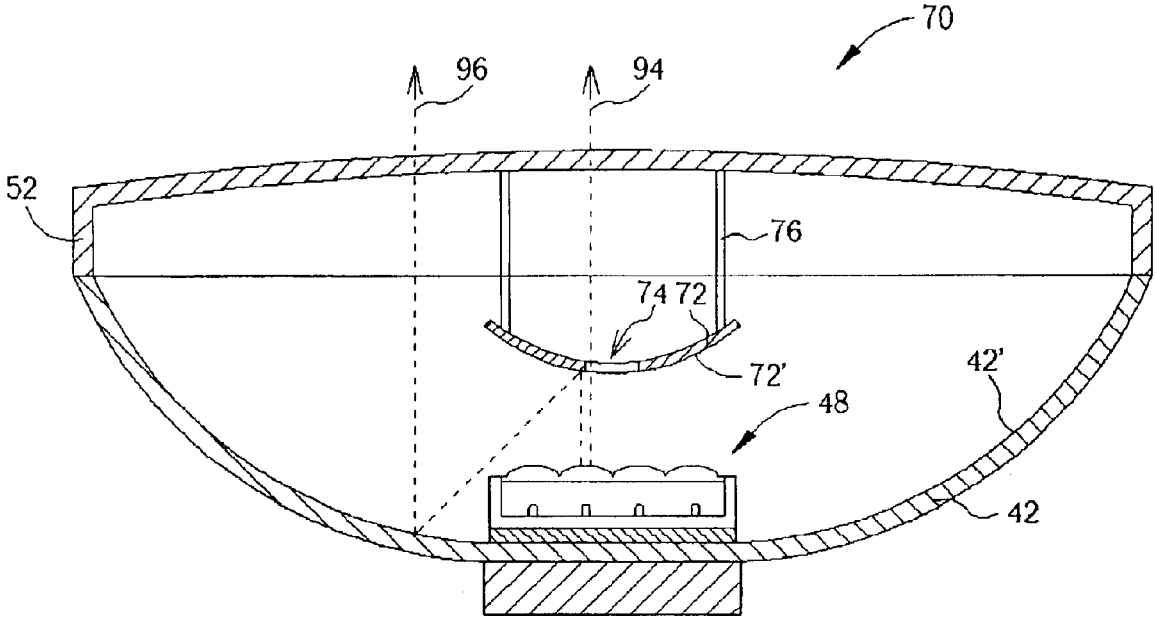
FIG. 5 is a cross-sectional view an LED lighting device according to a second embodiment of the present invention.

FIG. 5 shows a cross-sectional view of a second embodiment of the present invention. A lighting device 70 includes like numbered components of the lighting device 40, however, the lighting device 70 includes a convex mirror 72 replacing the convex mirror 44, the convex mirror 72 having a reflective surface 72" and an opening 74. The opening 74 is provided to allow a certain amount of light produced by the LED module to exit the lighting device 70 directly, without being reflected by the concave mirror 42. The opening 74 increases the intensity of light coming from the central part of the lighting device 70 and gives the lighting device 70 more evenly distributed light output. The lighting device 70 further includes stays 76 attaching the convex mirror 72 to the cover 52 replacing the stays 46 of the lighting device 40. The stays 76 can be in any number, three being sufficient to hold the convex mirror 72 in place. The stays 76 allow easy access to the LED module 48 when the cover 52 is removed, however, they required that the cover 52 be fitted properly during operation.

FIG. 5 shows light rays 94, 96 exiting the lighting device 70. The light ray 96 exits the lighting device 70 by reflecting from the convex and concave mirrors 72, 42 as in the first embodiment. The light ray 94 follows a different path and exits the lighting device 70 via the opening 74 in the convex mirror 72. The diameter of the opening 74 can be selected to vary the amount of light exiting the central part of the lighting device 70.

Figure 6:
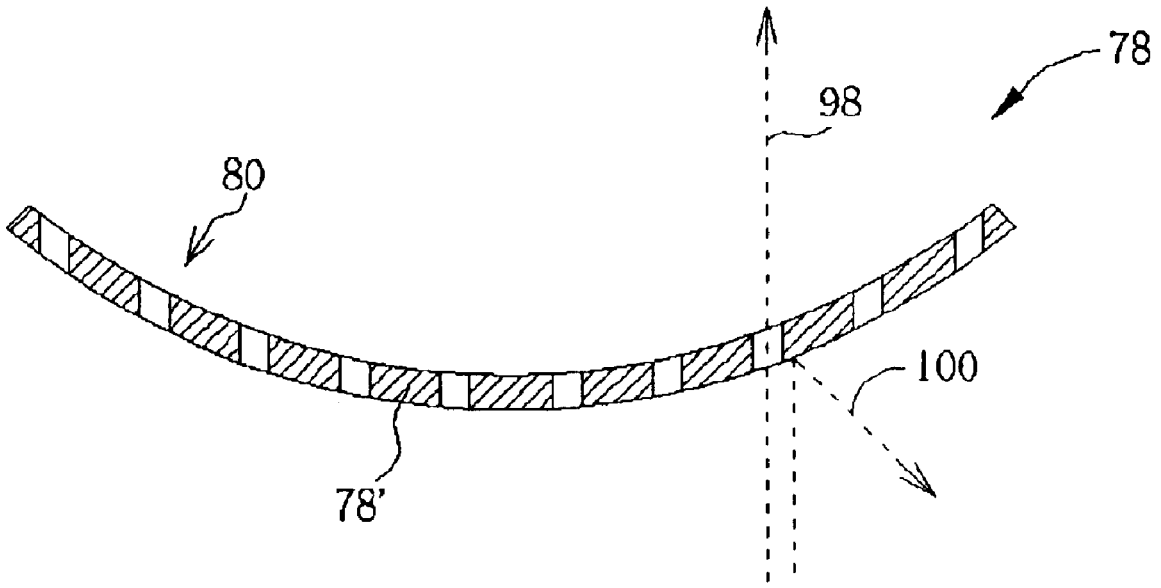
FIG. 6 is a cross-sectional view of an alternate embodiment of the convex mirror of FIG. 5.

FIG. 6 shows an alternative convex mirror 78 having a reflecting surface 78", the convex mirror 78 serving a similar function in the present invention as the convex mirrors 44 and 72. Rather than having a single central opening like the convex mirror 72, the convex mirror 78 has a plurality of openings 80 over its entire surface. The quantity, spacing, and diameter of the openings can be uniformly or non-uniformly selected to vary the amount of light exiting the central part of the lighting device 70, as illustrated by a light ray 98. Light that does not pass through an opening 80 is reflected back to the concave lens 42, as shown by a light ray 100.

Naturally, the variations of the convex mirror 44, 72, 78 and stays 46, 76 in the embodiments described can be combined in other embodiments according to the present invention. Moreover, if required by an application, the translucent cover 52 can be a lens for further focusing light exiting the LED lighting devices 40, 70.

In contrast to the prior art, the present invention concave and convex mirrors work in conjunction to provide even distribution of light emitted by an LED array.

Moreover, the convex mirror can be provided with a central opening or an arrangement of smaller openings to further evenly distribute light. The present invention provides improved performance over the prior art with a reduced number of components.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A lighting device comprising:

a concave mirror;

a convex parabolic mirror having a diameter less than a diameter of the concave mirror, the convex mirror positioned to face the concave mirror and fixed to the concave mirror, optical axes of the concave and convex mirrors being substantially collinear;

a light emitting diode (LED) array fixed to the concave mirror between the concave mirror and the convex mirror, the LED array facing the convex mirror such that light emitted by the LED array reflects off of the convex mirror, at least one LED of the array being away from the optical axis of the concave mirror; and a power supply for powering the LED array;

wherein light emitted by the LED array is reflected from the convex mirror onto the concave mirror and reflected by the concave mirror thereby exiting the lighting device.

2. The lighting device of claim 1 wherein the concave mirror is a parabolic mirror.

3. The lighting device of claim 1 wherein the concave mirror and the convex mirror are substantially confocal.

4. The lighting device of claim 1 wherein a central normal axis of the LED array is substantially collinear with the optical axis of the concave mirror.

5. The lighting device of claim 1 wherein the LED array is a flat circular array disposed on a substrate and each LED of the LED array comprises lens for focusing emitted light onto the convex mirror.

6. The lighting device of claim 5 wherein each lens is a Fresnel lens.

7. The lighting device of claim 1 wherein the concave and convex mirrors are metal or plastic bodies coated in optical reflective thin film forming the reflecting surfaces of the concave and convex mirrors.

8. The lighting device of claim 1 further comprising at least one stay attaching the convex mirror to the concave mirror.

9. The lighting device of claim 1 further comprising a translucent cover attached to the concave mirror spanning the diameter of the concave mirror for protecting the concave and convex mirrors and the LED array.

10. The lighting device of claim 9 wherein the convex mirror is fixed to the concave mirror by being attached to the translucent cover.

11. The lighting device of claim 9 wherein the translucent cover comprises a lens for focusing or diffusing light exiting the lighting device.

* * * * *